United States Patent [19]

Ichimura et al.

[11] Patent Number: 4,947,146

[45] Date of Patent: Aug. 7, 1990

[54] ELECTROMAGNETIC CONTACTOR

[75] Inventors: Yasuo Ichimura; Hidetoshi Matsushita; Kenji Kawasaki; Youichi Aoyama, all of Osaka, Japan

[73] Assignees: Matsushita Electric Works, Ltd., Osaka, Japan; Klöckner-Moeller Elektrizitäts-GmbH, Bonn, Fed. Rep. of Germany

[21] Appl. No.: 320,546

[22] Filed: Mar. 8, 1989

[51] Int. Cl.[5] ..... H01H 67/02

[52] U.S. Cl. ..... 335/131; 335/251

[58] Field of Search ..... 335/131-132, 335/126, 161, 251

[56] References Cited

U.S. PATENT DOCUMENTS 4,290,039 9/1981 Tochizawa ..... 335/251
4,509,026 4/1985 Matsushita .
4,734,669 3/1988 Matsushi et al. ..... 335/132

FOREIGN PATENT DOCUMENTS 58-192229 11/1983 Japan .
59-148303 8/1984 Japan .

*Primary Examiner*—Leo P. Picard
*Assistant Examiner*—Lincoln Donovan
*Attorney, Agent, or Firm*—Burns, Doane, Swecker & Mathis

[57] ABSTRACT

An electromagnetic contactor is formed by disposing an inner yoke to oppose at an end to a pole-contacting member provided at an end of an armature in an electromagnet block, disposing the outer yoke to oppose at an end to the said end of the inner yoke so as to restrict the displacement of the pole-contacting member and at the other end to a plunger part of the armature perpendicularly and closely thereto, and inserting a magnetic cylinder into an axial through hole of a coil bobbin of the electromagnet block for passing therethrough the plunger part from the side of the said other end of the outer yoke, whereby any leak of magnetic flux due to coil excitation and that of a permanent magnet disposed between the both yokes can be restrained to be the minimum and a highly efficient operation of the contactor can be realized.

6 Claims, 10 Drawing Sheets

ELECTROMAGNETIC CONTACTOR

TECHNICAL BACKGROUND OF THE INVENTION

This invention relates to an electromagnetic contactor in which a permanent magnet is interposed in a magnetic circuit formed in an electromagnetic block including an armature and a pair of yokes so that magnetic flux of a coil in the electromagnetic block will act on magnetic flux of the permanent magnet for shifting the armature to cause contacts in a contact block in the contactor to be opened and closed.

The electromagnetic contactor of the kind referred to finds its usefulness when the same is employed for closing and opening an electric path provided in connection with machine tools, electric heating means, air conditioning facilities and so on.

DISCLOSURE OF PRIOR ART

There have been employed in recent days various types of sequence control for optimumly driving the machine tools, electric heating means, air conditioning facilities and the like which are installed generally in manufacturing factories, business or service use buildings and the like. In carrying out such sequency control, it has been a measure to prepare a plurality of electromagnetic contactors in such that their input and output terminals are mutually connected in an organic manner for realizing the sequence control. With this measure, however, it has been a problem that required installation and mutual electric wiring for the plurality of contactors become complicated enough for rendering such maintenance works as inspection, repairing and so on to be also complicated. In order to overcome this problem, on the other hand, it has been suggested to realize the sequence control by employing a computer, program sequencer or the like in contactor operating circuit so that the respective electromagnetic contactors for each machine tool or the like could be operated through an interface relay by means of command signals based on preliminarily set program, whereby the contactor installation, electric wiring and so on could have been much simplified.

Now, the electromagnetic contactor generally comprises, as its basic elements, a contact block which takes a part of the electric path for closing and opening the path, and an electromagnet block which includes an armature for operating the contact block. While proper one of various types of the electromagnetic contactor is to be selected in accordance with supplied power amount and make-and-break capacity, required biasing load for contact pressure spring or reset spring is also elevated normally, so as to render required power supply amount to the coil to become larger in an event where the capacity in the electric path becomes larger. The employment of the computer, program sequencer or the like for the sequence control still confronts a difficulty in operating the electromagnetic contactors without any interposition of amplifying and boosting means due to that output signal power of the computer or program sequencer is small, and this tendency has been particularly remarkable in the case of non-polarized type electromagnetic contactor in which no permanent magnet is disposed within the magnetic circuit. Accordingly, it has been a demand to provide an electromagnetic contactor comprising a highly efficient electromagnet block which is actuatable with a relatively small power.

For the electromagnetic contactor having an electromagnet block made highly efficient, an exemplary one has been suggested in U.S. Pat. No. 4,509,026 of H. Matsushita, in which the electromagnetic contactor comprises an electromagnet block including an armature having a plunger and a pair of pole-contacting members secured to both ends of the plunger, a coil wound to be disposed about the plunger of the armature, inner yokes disposed at the periphery of the coil and between the pair of the pole-contacting members, and outer yokes disposed outside the inner yokes with permanent magnets interposed between them. In this electromagnetic contactor, the armature is moved between two forward and backward positions restricted by the inner and outer yokes as the coil is excited and deexcited, and a contact means is thereby operated to make and break contacts, while magnetic fluxes of the permanent magnets are superposed on magnetic flux of the coil or act to cancel the latter so that the operation can be achieved with a relatively small power.

In the foregoing electromagnetic contactor of Matsushita, however, there has been still involved such a drawback that, due to its arrangement so made that gaps or the permanent magnets must be always present in magnetic flux path from the coil, an attractive force upon excitation of the coil with a rated current cannot be made sufficiently large relative, to an attractive force of the permanent magnets occurring during the deexcitation of the coil, that is, the highly efficient operation intended cannot be fully realized.

Further, in Japanese Patent Application Laid-Open Publication No. 59-148303 of H. Matsushita, there has been disclosed an electromagnetic contactor in which a plunger part having a pole-contacting portion is provided to an end of an armature in an electromagnet block, a coil is wound about this plunger part of the armature, an inner yoke is disposed on the periphery of the coil so as to be opposed on one end side to the pole-contacting portion at an end of the armature, and an outer yoke is so arranged as to be outside the inner yoke with a permanent magnet interposed between them and as to be opposed on one end side to the one end side of the inner yoke for restraining displacing extent of the pole-contacting portion. In this contactor wherein the coil excitation and deexcitation cause the contact block to be actuated to make and break the contacts, there is present no gap nor permanent magnet in the magnetic flux path of the coil when the armature is in its actuated position, that is, where the pole-contacting portion is at a position adjacent the one end side of the outer yoke, so that the attractive force upon the coil excitation with the rated current can be made considerably larger than in the case of the foregoing U.S. patent, and the highly efficient operation can be realized.

It is preferable, on the other hand, that the electromagnetic contactor is so arranged that movable contacts are brought into reliable contact with stationary contacts in the contact block, by forming contacting surface of the movable contacts to be curved for achieving a rolling with the center of the curvature of the contacting surface made as the center of the rolling when the movable contacts engage contacting surfaces of the stationary contacts under a biasing load of contacting pressure springs upon the making of the contacts. In this respect, the electromagnetic contactor has been requested to be improved in inherent requisite of a large total biasing load and thus a large input voltage for operating a plurality of pairs of the contacts, in the case where the biasing load of the contacting pressure springs is made larger in order to increase the contacting pressure, or the biasing load of resetting springs is made larger for preventing welding between the movable and stationary contacts. As a positive measure for eliminating such welding of the contacts, another electromagnetic contact is suggested in Japanese Patent Application Laid-Open Publication No. 58-192229 of A. Hirao, in which means is provided to engage the movable contacts upon movement of the armature in contact breaking direction for tripping the movable contacts from the stationary contacts. Though this tripping means has been effective to reduce the resetting spring load, it has been still required to reduce the total biasing load.

In achieving the highly efficient operation of the electromagnetic contactor, therefore, it is required to provide an optimum arrangement with which the attractive force of the permanent magnet during the deexcitation of the coil is made smaller relative to the total biasing load while the electromagnetic attractive force of the coil upon its excitation with the rated current can be increased, with any manufacturing tolerance absorbed.

TECHNICAL FIELD

A primary object of the present invention is, therefore, to provide an electromagnetic contactor which is capable of reliably reducing the attractive force during the coil deexcitation while reliably increasing the attractive force upon the coil excitation with the rated current, so as to effectively realizing the highly efficient operation.

According to the present invention, the object can be attained by a provision of an electromagnetic contactor wherein an armature in an electromagnet block is provided at an end of a plunger part with a pole-contacting member, a coil is wound on a bobbin passing through an axial hole thereof the plunger part of the armature for its axial displacement, an inner yoke is disposed to be peripherally about the coil and to oppose outer surface of the pole-contacting member of the armature, an outer yoke is disposed to oppose the inner yoke with a permanent magnet interposed between them and to oppose a part of the inner yoke facing the pole-contacting member for restraining its displacement, and movable contacts of a contact block are caused through a coupling means by the displacement of the armature to make and break their contact with stationary contacts, the contactor being featured in that the outer yoke is further made to oppose the other end of the plunger part so as to extent perpendicularly and adjacent thereto, and a magnetic cylinder of an axial length sufficiently larger than a width of the outer yoke at its portion opposing the other end of the plunger part and of an inner diameter slightly larger than an outer diameter of the plunger part of the armature is inserted in the axial hole of the bobbin to be at the position of the outer yoke portion opposing the other end of the plunger part.

In this electromagnetic contactor according to the present invention, the disposition of the magnetic cylinder about the armature plunger part over a portion thereof on its other end side than that carrying the pole-contacting member allows any leakage of the magnetic fluxes of the coil upon its excitation and of the permanent magnet to be made the minimum in contrast to conventional contactors, and the highly efficient operation of the contactor can be effectively realized.

Other objects and advantages of the present invention shall be made clear in following explanation of the invention detailed with reference to a preferred embodiment shown in accompanying drawings.

While the present invention shall now be explained with reference to the embodiment shown in the accompanying drawings, it should be appreciated that the intention is not to limit the invention only to the embodiment shown but rather to include all alterations, modifications and equivalent arrangements possible within the scope of appended claims.

DISCLOSURE OF PREFERRED EMBODIMENT

Figure 8:
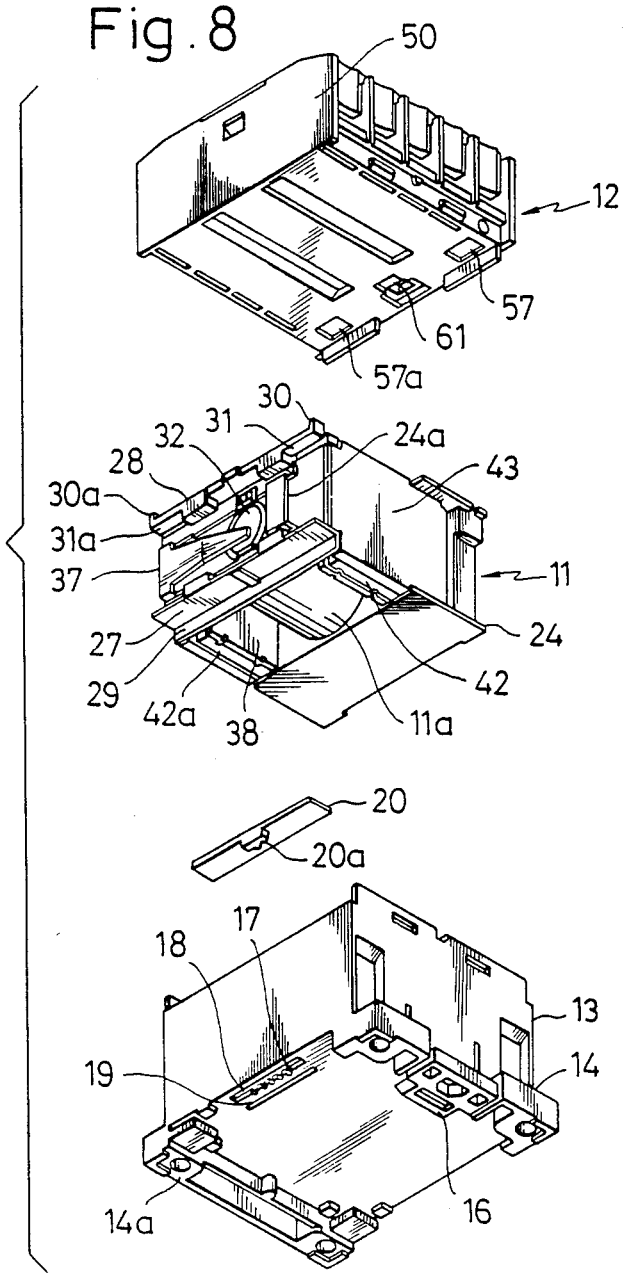
FIG. 8 is a perspective view of the contactor of FIG. 1 in a half assembled state and as seen from bottom side.
Figure 10A:
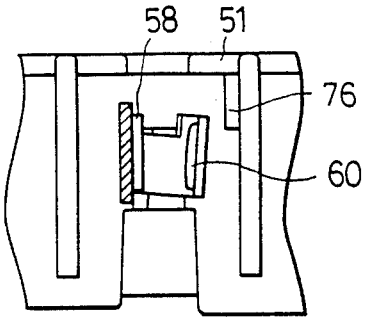
FIGS. 10 (*a*) through 10(*d*) are explanatory views for contact making, operation in the contactor of FIG. 1.
Figure 10B:
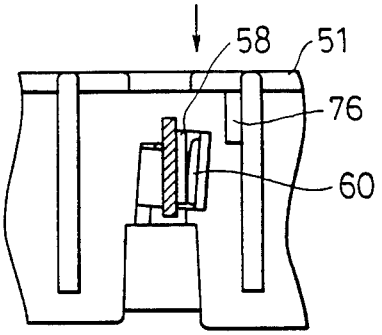
Figure 10C:
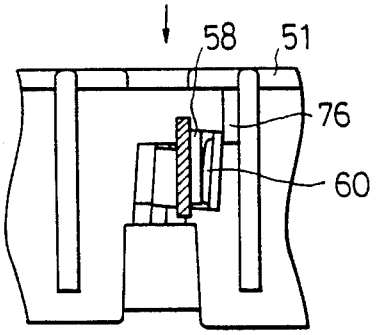
Figure 10D:
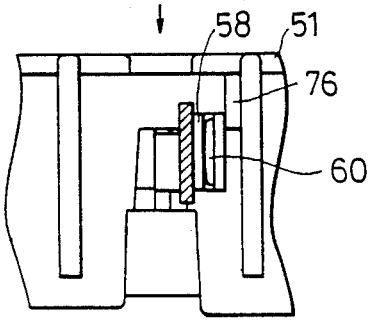

Referring now to FIGS. 1 through 8, the electromagnetic contactor 10 shown here according to the present invention comprises generally an electromagnet block 11 disposed on lower side of the contactor, a contact block 12 mounted on the electromagnet block 11 and a casing 13 opened at the top for housing therein mainly the electromagnet block 11. The casing 13 is provided at bottom edges of two opposing sides with mounting steps 14 and 14*a* having through holes for passing mounting screws, pins or the like, and these steps 14 and 14*a* may be formed as required to have an inward projection 15 or engaging hole 16 adapted to a mounting object therefor. In bottom plate of the casing 13 along a side other than those having the steps 14 and 14*a*, there is made a slot 18 having in one elongated side a plurality of notches 17 and a slot 19 parallel to the side having the notches 17 for providing to the side a resiliency (FIG. 8). An adjusting piece 20 having a downward projection 20*a* is placed inside the casing 13 with the projection 20*a* engaged in one the notches 17 of the slot 18 in the bottom of the casing 13, so that the adjusting piece 20 may be shifted with the projection 20*a* operated externally from the bottom side to be engaged in any other selected one of the notches 17, utilizing the resiliency of the notched side of the slot 18 by means of the parallel slot 19. The adjusting piece 20 shown as an elongated member is made to vary, for example, in the thickness from one longitudinal end to the other to have a proper thickness difference between them. Accordingly, the adjusting piece 20 disposed underside the electromagnet block 11 slidably engages the bottom of the block 11 so as to be able to cause the block 11 to be slightly variable in its inclination with respect to the bottom surface of the casing 13.

Figure 1:
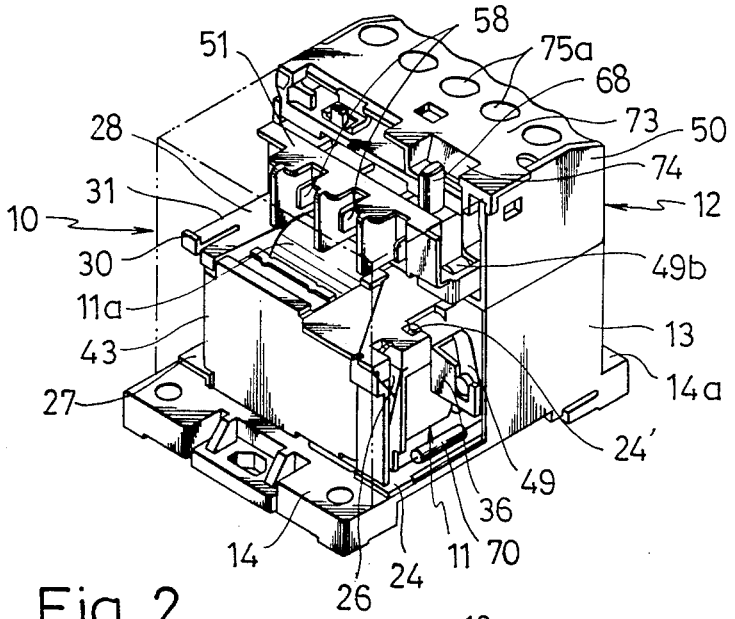
FIG. 1 is a perspective view in assembled state of the electromagnetic contactor according to the present invention with a part of its casing shown by imaginary lines.
Figure 2:
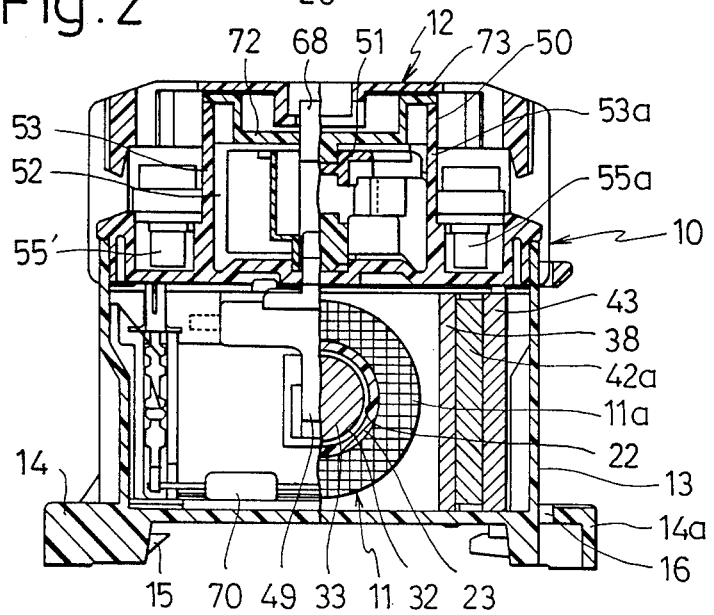
FIG. 2 is a vertically sectioned view of the contactor of FIG. 1 taken at different positions for both half parts thereof.
Figure 4:
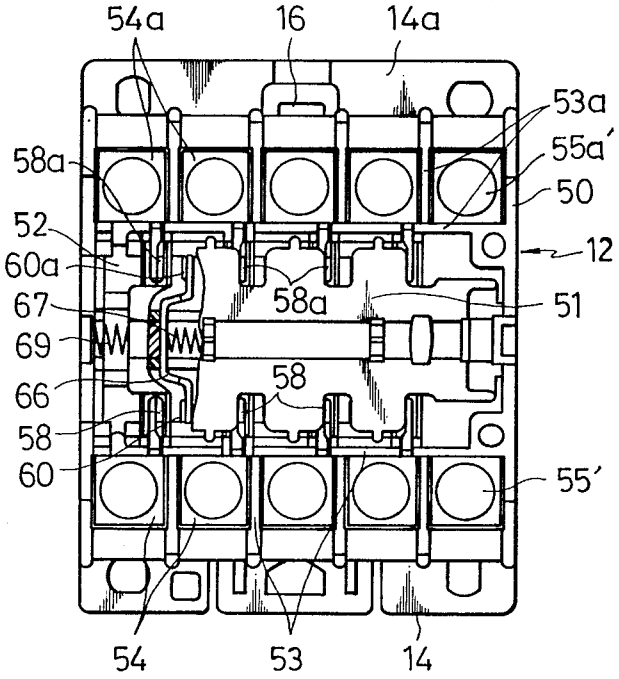
FIG. 4 is a cross-sectional view of the contactor of FIG. 2 showing mostly its contact block.
Figure 3:
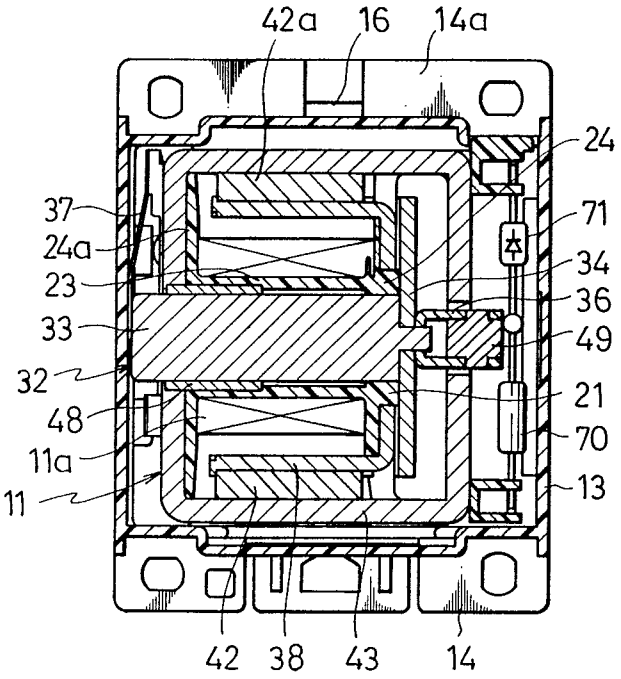
FIG. 3 is a cross-sectional view of the contactor of FIG. 1 for showing mainly its electromagnet block.
Figure 5:
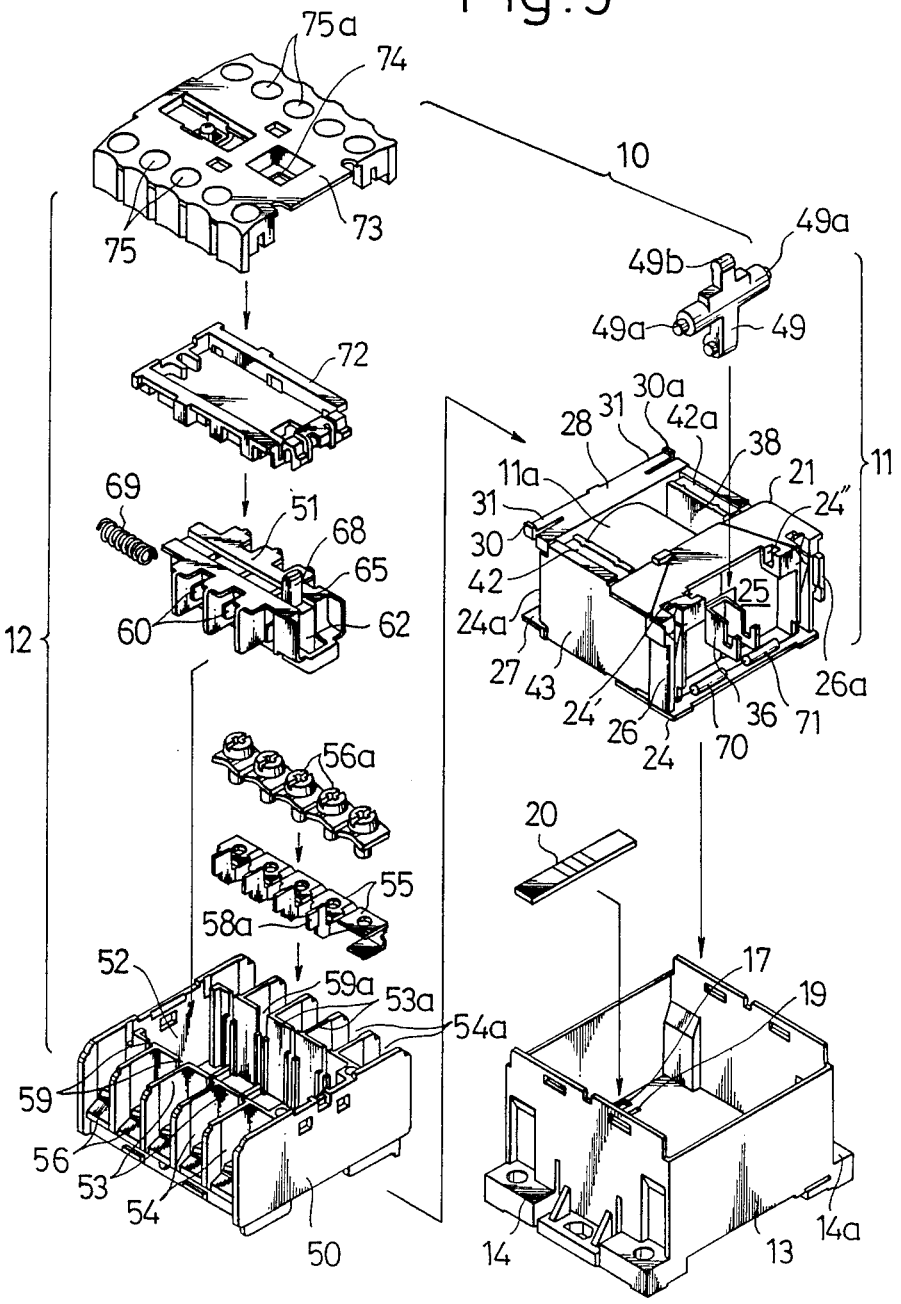
FIG. 5 is a perspective view in a state disassembled into respective components of the contactor of FIG. 1.
Figure 6:
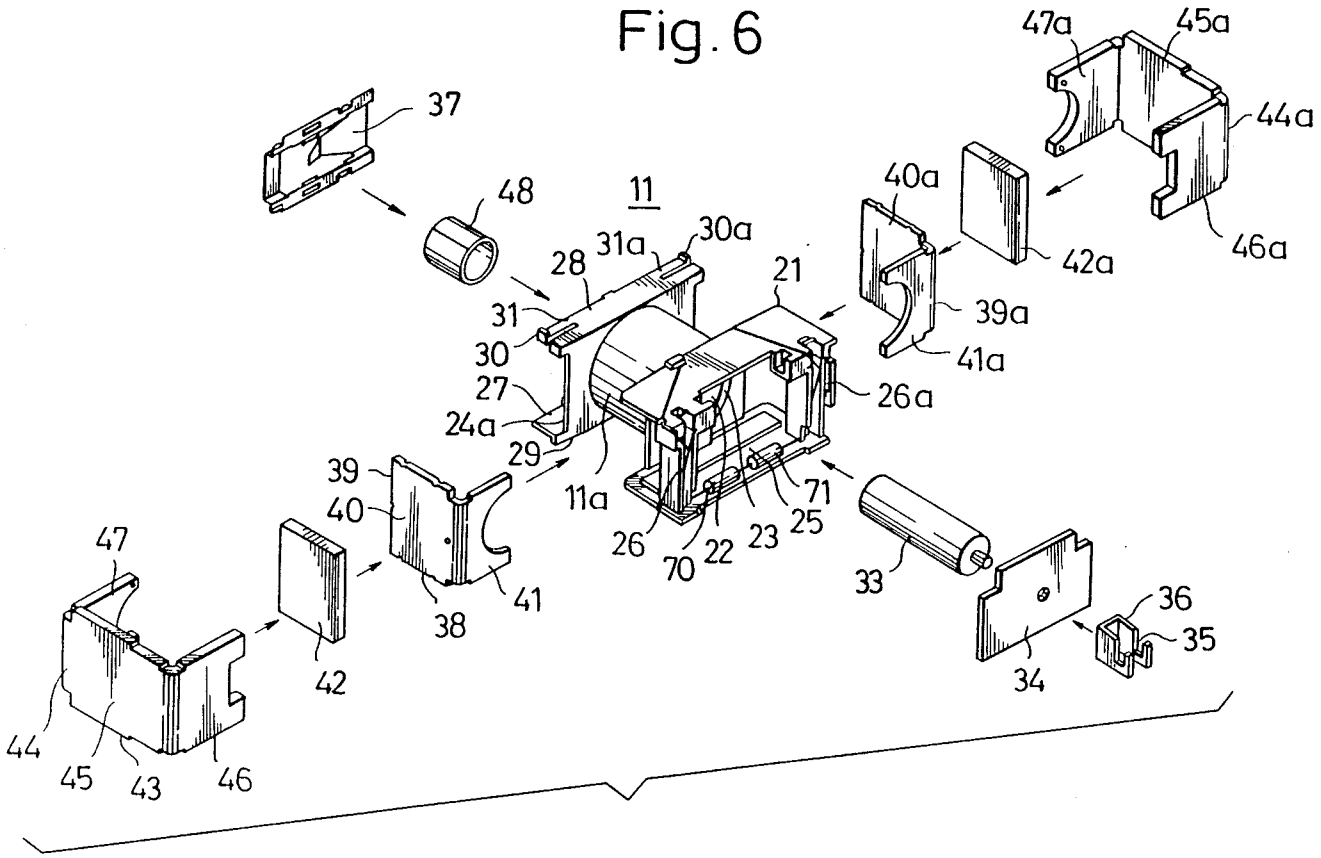
FIG. 6 is a perspective view as disassembled of the electromagnet block in the contactor of FIG. 1.

The electromagnet block 11 comprises a coil 11*a* wound on a bobbin 21 which includes a coil winding body 23 having an axial through hole 22 and two parallel flanges 24 and 24*a* at both end edges of the body 23. One end flange 24 is formed to define a generally box-shaped operating space 25 relatively deep in the axial direction of the coil winding body 23 while two connecting parts 26 and 26*a* for leading ends of the coil 11*a* are formed at opposing positions of the flange 24 (FIGS. 5 and 6). The other end bobbin flange 24*a* has lower and upper side walls 27 and 28 and a downward extension 29 angled with respect to the lower side wall 27 to be L-shaped therewith in section (FIG. 8), and this downward extension 29 rides on the adjusting piece 20 at the bottom of the casing 13. The upper side wall 28 of the flange 24*a* is formed to have at both end portions push-up arms 31 and 31*a* made thin to be elastic and to have upward end projections 30 and 30*a*. In the axial through hole 22 of the bobbin 21, a plunger part 33 of an armature 32 is inserted to pass therethrough, and a pole-contacting plate member 34 and a supporting member 36 having a supporting notches 35 are secured to a plunger end disposed on the side of the bobbin flange 24 so as to be disposed in the operating space 25 of the flange 24. A pressing plate-spring 37 is disposed between the flange 24*a* and an opposing side wall of the casing 13 as resiliently engaged to the other end of the plunger part 33 so as to normally bias the plunger part 33 axially toward the side of the bobbin flange 24 defining the operating space 25.

An inner yoke 38 is disposed to be close to the coil 11*a* wound on the body 23 of the bobbin 21, and this inner yoke 38 is formed, for example, by a pair of yoke halves 39 and 39*a* which are joined as engaged edgewise to each other. These inner yoke halves 39 and 39*a* are respectively formed to have main plate part 40 or 40*a* and an end part 41 or 41*a* extended at an angle from an end edge of the main plate part so that, when both halves 39 and 39*a* are engaged to join each other, the main plate parts 40 and 40*a* are disposed to be in parallel to the plunger part 33 of the armature between the both bobbin flanges 24 and 24*a*, while the facing parts 41 and 41*a* abut outer face of the flange 24 in perpendicular relation to the plunger part 33 and allowing it to pass through an aperture defined between the both facing parts 41 and 41*a*. In the assembled state, the end parts 41 and 41*a* are positioned to be closer to the coil 11*a* than the pole-contacting member 34 ,secured, to an end of the plunger part 33 to form with the end parts 41 and 41*a* normally with a clearance. On an outer side of the inner yoke 38, an outer yoke 43 is disposed with a pair of plate-shaped permanent magnets 42 and 42*a* interposed between them as placed along the main plate parts 40 and 40*a*. The outer yoke 43 is also formed, for example, by a pair of yoke halves 44 and 44*a* which are joined as engaged edgewise to each other, and these halves 44 and 44*a* are substantially U-shaped respectively as seen from the top in the assembled state of FIG. 1 so as to enclose the coil bobbin 21 including the inner yoke 38, disposing main plate parts 45 and 45*a* in parallel to the plunger part 33 of the armature. End parts 46 and 46*a* extending from an end of the main plate parts 45 and 45*a* of the U-shaped outer yoke halves 44 and 44*a* are placed to oppose externally of the pole-contacting member 34 which internally opposes the end parts 41 and 41*a*, so that the displacement of the pole-contacting member 34 as well as the plunger part 33 of the armature 32 will be restricted by the end parts 41, 41*a* and 46, 46*a*. End parts 47 and 47*a* extended from the other end of the main plate parts 45 and 45*a* are disposed to be perpendicular to the other end part of the armature plunger part 33 while defining an aperture for accommodating the plunger end part when the halves are joined.

Figure 15:
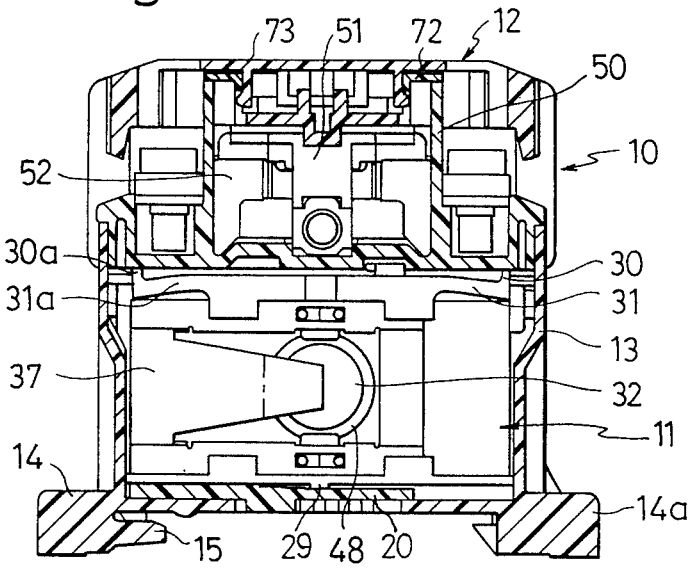
FIGS. 15 and 16 are operation explanatory views for the electromagnet and contact blocks respectively in a state where the contact making timing is advanced in the contactor of FIG. 1.
Figure 16:
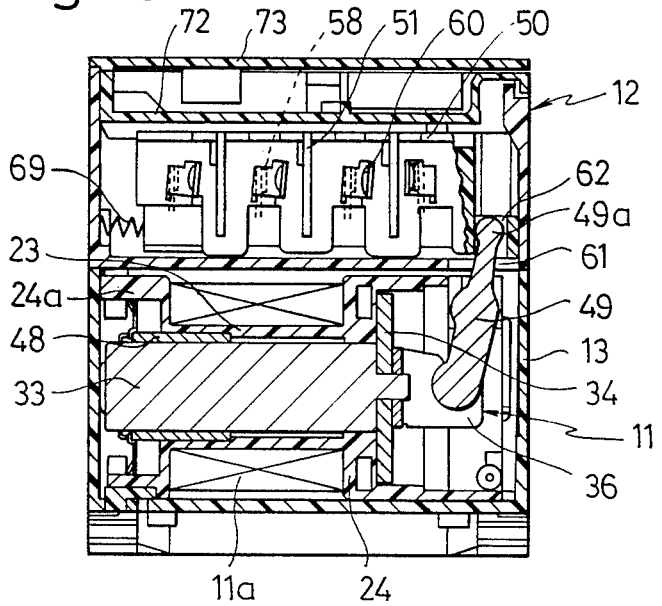

Further, a magnetic cylinder 48 is inserted into the axial through hole 22 of the coil bobbin 21 through the parts 47 and 47*a* so as to enclose partly the plunger part 33 of the armature 32 over a length sufficiently larger than the width W of the bent parts 47 and 47*a* of the outer yoke 43. The magnetic cylinder 48 is circumferentially continuous in that it contains no axial through-slot (see FIGS. 6 and 15 for example.) A substantially cruciform shaped coupling member 49 is fitted to the supporting member 36 with lateral projections of a downward arm of the coupling member 49 engaged in the supporting notches 35 of the supporting member 36, while central shaft ends 49*a* are engaged in shaft-bearing recesses 24' and 24'' made in the one end flange 24 of the bobbin so as to be rockable about the shaft ends 49*a* following the displacement of the armature 32.

The contact block 12 mounted on the electromagnet block 11 comprises a contact housing body 50 which is mounted onto the casing 13. The electromagnet block 11 as properly coupled to the casing through any known coupling means, in which mounted state the bottom face of the contact block 12 is resiliently engaged to the upward end projections 30 and 30*a* of the push-up arms 31 and 31*a* formed in the other end flange 24*a* of the bobbin 21, so that the electromagnet block 11 will be urged downward by the contact block 12 to be positively seated within the casing 13. In a central zone of the contact housing body 50, there is defined a compartment 52 for slidably receiving therein a movable base body 51 and, on both sides of this compartment 52, there are defined by means of separators 53 and 53*a* two groups of external terminal cells 54 and 54*a*, in which external terminal metal fittings 55 and 55*a* is fitted, together with terminal screws 56 and 56*a* are driven into the fittings 55 and 55*a*. Among these terminal metal fittings 55 and 55*a*, there are extreme end positioned metal fittings 55' and 55*a'* disposed right above the coil end connecting parts 26 and 26*a* of the one end bobbin flange 24. The fittings 55' and 55*a'* are engaged to these connecting parts 26 and 26*a* through apertures 57 and 57*a* made in the bottom of the contact housing body 50 (FIG. 8) and electrically connected to the leading ends of the coil 11*a* by means of any known connecting means such as plug blades and blade receiving fittings at the same time when the contact block 12 is mounted onto the electromagnet block 11. Between the terminal metal fittings 55 and 55*a* and the terminal screws 56 and 56*a*, external wires (not shown) are to be held and connected thereto.

To respective ones of the external terminal metal fittings 55 and 55*a*, stationary contacts 58 and 58*a* are provided integrally so that the stationary contacts 58 and 58*a* will project into the compartment 52 from the respective external terminal cells 54 and 54*a* through slits 59 and 59*a* made in the separators 53 and 53*a*. To the movable base body 51 housed in the compartment 52, movable contacts 60 and 60*a* corresponding respectively to the stationary contacts 58 and 58*a* of the external terminal metal fittings 55 and 55*a* are mounted for engaging with and disengaging from these stationary contacts 58 and 58*a* upon sliding movement of the movable base body 51. In the compartment 52, further, a top extending arm 49*b* of the coupling member 49 extends through an aperture 61 made in the bottom of the contact housing body 50, and this arm 49*b* rounded is freely engaged in an engaging hole 62 made in the movable base body 51.

The movable base body 51 comprises an inner base 64 having a plurality of upstanding resilient hook-shaped engaging projections 63, and an outer base 65 coupled by the engaging projections 63 to the inner base 64 so that a plurality of spaces will be defined upon the coupling. In these spaces, movable contact plates 66 carrying at both ends the movable contacts 60 and 60*a* are accommodated respectively with a biasing load applied by contact pressure springs 67 disposed also within the spaces, whereby an optimum contact pressure can be provided to the movable contacts 60 and 60*a* upon their engagement with the stationary contacts 58 and 58*a*. On the top side of the outer base 65 of the movable base body 51, an operating knob 68 is erected. Further, a resetting spring 69 is provided within the compartment 52 as disposed between an end wall of the movable base body 51 opposite to the side having the engaging hole 62 and an inner side wall of the housing body 50 facing the base body end wall, so as to normally bias the movable base body 51 in a direction toward its end at which the base body 51 is coupled through the coupling member 49 to the armature 32 in the electromagnet block 11.

Further, between the coil end connecting parts 26 and 26*a* as well as between the external terminal metal fittings 55' and 55*a'* connected to them, a resistor 70 and a constant voltage diode 71 are connected as housed within the casing 13, so that any surge voltage can be reduced by these resistor 70 and diode 71 upon interruption of a current fed to the coil 11*a*.

Within the compartment 52, further, a frame 72 is mounted to the housing body 50 as disposed above the movable base body 51, and a terminal covering lid 73 is fitted thereover onto the body 50, which lid 73 has an aperture 74 for exposing the operating knob 68 of the movable base body 51 as well as round holes 75 and 75*a* for rendering the terminal screws 56 and 56*a* to be accessible from above.

Figure 11:
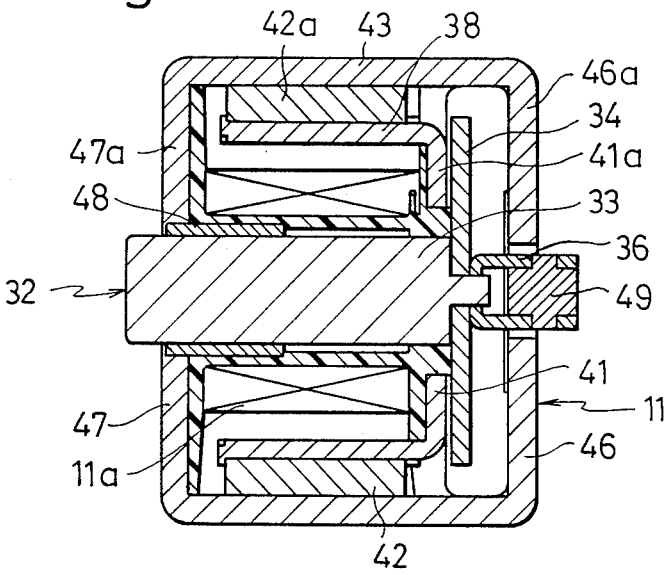
FIG. 11 is an explanatory view for a state in which the electromagnet block is deexcited in the contactor of FIG. 1.
Figure 12:
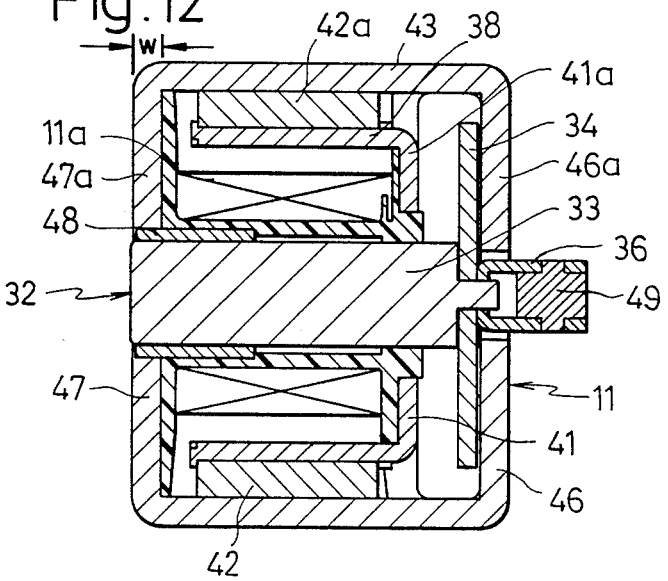
FIG. 12 is an explanatory view for an operation upon excitation of the electromagnet block in the contactor of FIG. 1.

The operation of the electromagnetic contactor 10 according to the present invention shall now be referred to. When the coil 11*a* of the electromagnet block 11 is not excited, as shown in FIG. 11, the pole-contacting member 34 of the armature 32 is positioned on the side closer to the facing parts 41 and 41*a* at the one end of the inner yoke 38, which position shall be referred to as a retracted position of the plunger part 33 of the armature 32. In this state, the magnetic fluxes of the permanent magnets 42 and 42*a* interposed between the inner and outer yokes 38 and 43 are passing sequentially through the inner yoke 38, pole-contacting member 34, plunger part 33, magnetic cylinder 48 and outer yoke 43, and act to attract the whole of the armature 32 into the retracted position. When, on the other hand, the coil 11*a* of the electromagnet block 11 is excited, as shown in FIG. 12, the magnetic flux yielded by the coil 11*a* passes sequentially through the armature plunger part 33, magnetic cylinder 48, outer yoke 43, gap between the facing parts 46 and 46*a* of the outer yoke 43 and the pole-contacting member 34 of the armature 32 and finally this pole-contacting member 34, where this magnetic flux generates a force attracting the armature pole-contacting member 34 onto the side of the facing parts 46 and 46*a*. The pole-contacting member 34 is thereby displaced closer to the facing parts 46 and 46*a* of the outer yoke 43, together with the plunger part 33 which defines a projected position of the plunger part 33. In this projected state of the pole-contacting member 34, the magnetic path through the plunger part 33, magnetic cylinder 48, outer yoke 43 and pole-contacting member 34 involves no substantial gap except a slight clearance only enough for preventing any abnormal increase in the attractive force between the pole-contacting member 34 and the outer yoke 43 due to the attracted contact of the former to the latter, and the magnetic reluctance is made the minimum.

Figure 9:
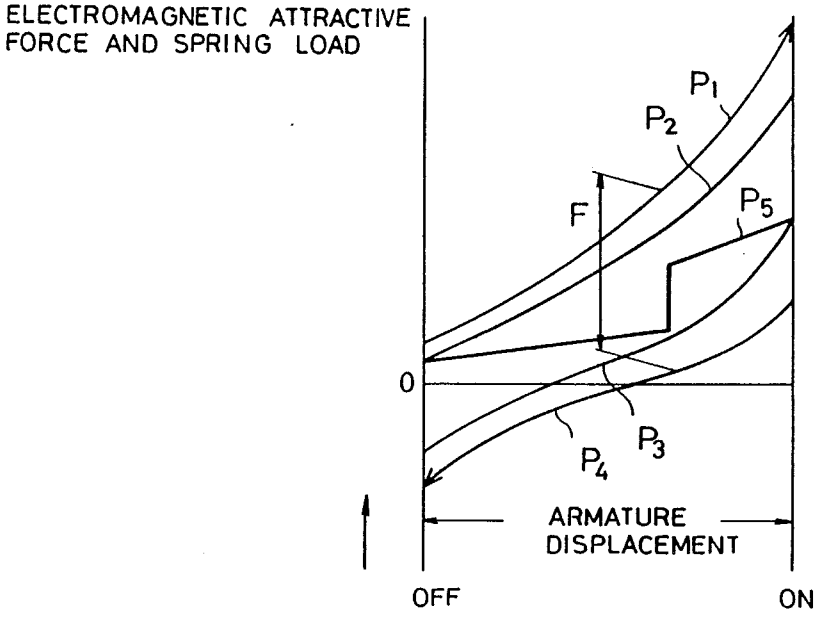
FIG. 9 is a diagram showing operational characteristics of the contactor of FIG. 1.
Figure 7:
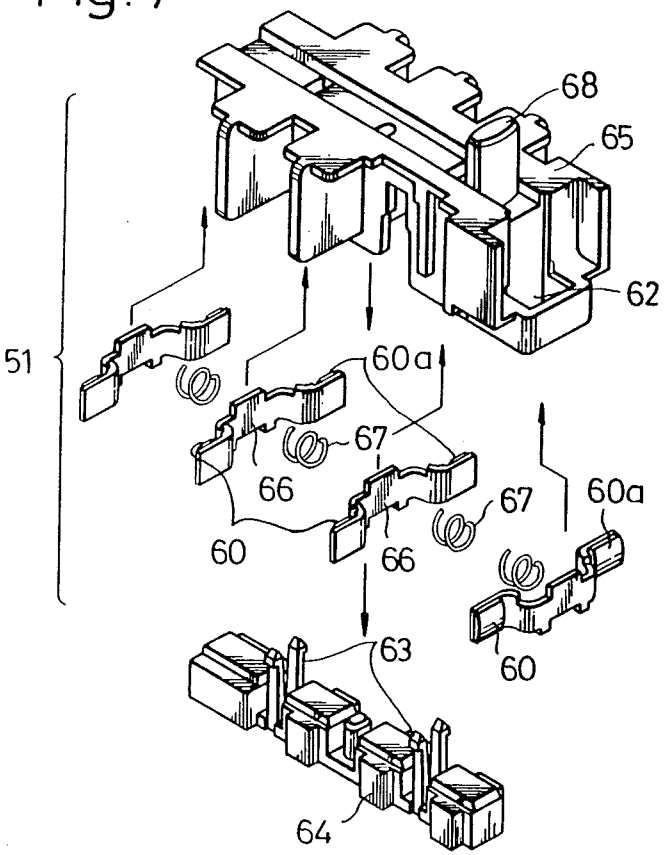
FIG. 7 is a perspective view as disassembled of the contact block in the contactor of FIG. 1.

According to the electromagnet block 11*a* of the present invention having such a unique magnetic circuit as described above, as shown in FIG. 9, a difference F between an attractive force curve P4 upon the deexcitation and another attractive force curve P1 upon the excitation with a rated current fed is small so long as the armature plunger 33 is at the retracted position, that is, the armature 32 is on OFF side. On the other hand, the difference F becomes larger between the attractive force curve P4 upon the deexcitation and that P1 upon the excitation when the armature plunger 33 is at its projected position, that is, the armature plunger 33 is on ON side so that the armature will be operatable with a relatively small current and a highly efficient operation can be assured. In FIG. 9, there are also shown an attractive force curve P2 upon sensitive current, attractive force curve P3 upon releasing current, and total spring load curve P5.

As the coil 11*a* is excited to have the armature 32 displaced to the projected position, the coupling member 49 coupled at the lower arm to the armature 32 is caused to rock about the central shaft ends 49*a* as the fulcrum, whereby the movable base body 51 in the contact block 12 coupled to the top projecting arm 49*b* of the coupling member 49 is made to slide. During this sliding movement of the movable base body 51, the movable contacts 60 and 60*a* carried on the base body 51 are displaced toward the stationary contacts 58 and 58*a* to be eventually brought into contact with them. In this case, the movable contacts 60 and 60*a* are mounted in an inclined state with respect to the stationary contacts 58 and 58*a*, as shown in FIG. 10(*a*) in the deexcitation state. When the movable base body 51 slides in this state, the movable contacts 60 and 60*a* initially engage the stationary contacts 58 and 58*a* in the inclined state as shown in FIG. 10(*b*), thereafter the contacting pressure is applied by the springs 67 to the movable contacts 60 and 60*a*, and thereby the movable contacts 60 and 60*a* are caused to roll on the stationary contacts 58 and 58*a* gradually. With this rolling, the movable contacts 60 and 60*a* are made to contact the stationary contacts 58 and 58*a* at new contacting zones sequentially changed, and their contacting reliability can be improved. Further, in the initial stage of the contact as shown in FIG. 10(*b*), a large current is caused to flow between the stationary and movable contacts 58, 58*a* and 60, 60*a* so that they will easily come into welding state. In the present instance, the movable base body 51 is provided therein with an urging projection 76 so that, in further moving stroke of the base body 51 and movable contacts 60 and 60*a*, the projection 76 will abut each of the movable contacts 60 and 60*a* to urge them to reliably perform the rolling motion and, even when the welding has happened between both contacts, they are released from such bonding state. The biasing load of the contact pressure springs 67 can be thereby made smaller, the total biasing load of these springs can be made smaller in the rising as shown by a curve P5 in FIG. 9, and the operating efficiency upon the excitation of the coil 11*a* can be remarkably improved in this respect, too.

Figure 13:
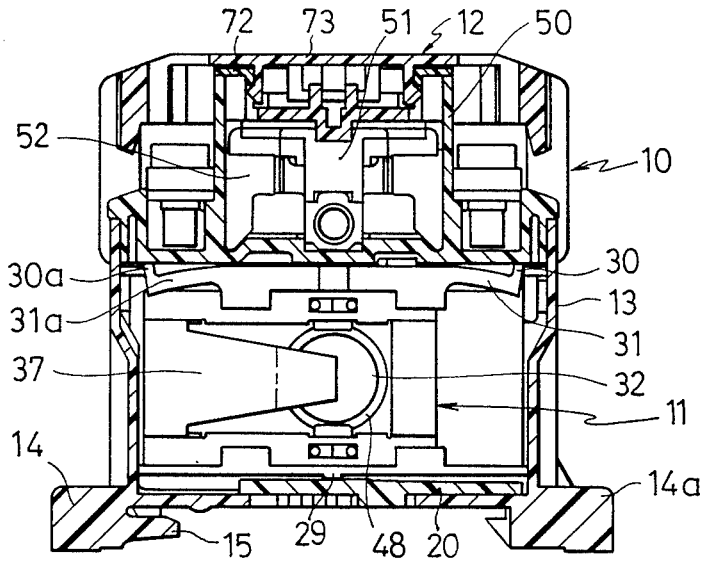
FIGS. 13 and 14 are operation explanatory views for the electromagnet and contact blocks respectively in a state where contact making timing is delayed in the contactor of FIG. 1.
Figure 14:
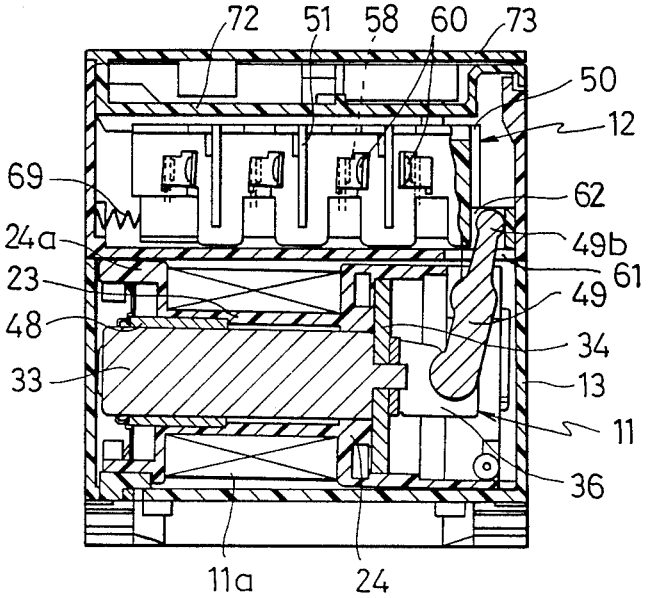

In the electromagnetic contactor 10 according to the present invention, further, the electromagnet block 11 can be made variable in its relative position with respect to the contact block 12, and thereby the movable contacts 60 and 60*a* can be made adjustable in the contacting timing with respect to the stationary contacts 58 and 58*a*. That is, in a state where the foregoing adjusting piece 20 is shifted in one direction, as shown in FIGS. 13 and 14, there is provided a clearance in the coil deexcitation state between a peripheral side wall face of the engaging hole 62 in the movable base body 51 and engaging face of the top extending arm 49*b* of the coupling member 49, so that the rocking motion of the coupling member 49 following the armature displacement will not immediately be transmitted to the movable base body 51 to render cooperating motion of the latter to slightly delay and the contacting timing can be eventually delayed. In a state where the adjusting piece 20 is shifted in the other direction, on the other hand, the engaging faces of the hole 62 and coupling member 49 are brought closer to render the clearance to be substantially zero, so that the movable base body 51 can immediately cooperate with the rocking of the coupling member 49 so as to advance the contacting timing. Accordingly, the attractive force curve P4 upon the deexcitation and spring load curve P5 shown in FIG. 9 can be made adjustable so as to render them relatively shifted in parallel to each other and, in this respect, too, an excellent operational efficiency can be realized with the attractive force characteristics optimumly adjusted.

In the present invention, the arrangement allows various design modifications to be made possible. For example, the arrangement has been disclosed in such that the contacts are made upon the coil deexcitation and are broken upon the coil excitation, but this can be made so that the contacts are made upon the coil excitation and broken upon the deexcitation. While the urging projections 76 for forcibly rolling the movable contacts 60 and 60*a* should preferably be provided at a position corresponding to the maximum moving stroke of the movable base body 51 and of the movable contacts 60 and 60*a* as well in order that the projections 76 will act only upon occurrence of the welding between the both contacts, further, any other arrangement can be likewise utilized so long as the same operation can be achieved.

What is claimed is:

1. An electromagnetic contactor comprising:

an electromagnetic block including:

an armature having a plunger part with first and second axially spaced ends, and a pole-contacting part mounted on only one of said ends of said plunger part, a bobbin carrying a coil wound thereon and having an axial through-hole, said plunger part being inserted in said through-hole for displacement in an axial direction, an inner yoke disposed around a peripheral portion of said coil and having a first end portion opposing said pole-contacting part of said armature, an outer yoke having a second end portion opposing said inner yoke in axially spaced relation to said first end portion of said inner yoke for restricting said displacement of said pole-contacting part of said armature, and a third end portion extending substantially perpendicularly toward said plunger part of said armature, said third end portion having a width dimension extending in a direction parallel to said axial direction, a permanent magnet interposed between said inner and outer yokes in a direction laterally of said axial direction, and a magnetic cylinder of an axial length larger than said width dimension of said third end portion of said outer yoke and of an inner diameter slightly larger than an outer diameter of said plunger part, said magnetic cylinder being of continuous structure in its circumferential direction and inserted into said axial through-hole of said bobbin from an end of said bobbin disposed adjacent said third end portion whereby said magnetic cylinder is disposed laterally between said outer yoke and said plunger part for slidably guiding said plunger, a coupling means coupled to said armature of said electromagnetic block for axial displacement therewith, and a contact block including a group of stationary contacts, and a group of movable contacts coupled to said coupling means for making and breaking contact with said stationary contacts in response to said axial displacement of said armature, one of said groups of contacts being spring loaded.

2. A contactor according to claim 1, wherein said outer yoke encloses therein said inner yoke and said permanent magnet.

3. An electromagnetic contactor comprising:

an electromagnetic block including an armature having a plunger part and a pole-contacting member mounted on only one end of said plunger part, a bobbin carrying a coil wound thereon and having an axial through-hole in which said plunger part of said armature is inserted for axial displacement, an inner yoke extending around a peripheral portion of said coil and having a first end portion opposing said pole-contacting member of sid armature, an outer yoke having a second end portion opposing said first end portion of said inner yoke for restricting said displacement of said pole-contacting member of said armature and a second end portion extending toward said plunger part of the armature, and a permanent magnet interposed between said inner and outer yoke, a coupling means coupled to said armature of said electromagnetic block for being displaceable therewith, a contact block including a group of stationary contacts, and a group of movable contacts coupled to said coupling means for making and breaking contact with said stationary contacts in response to said axial displacement of said armature, the contacts of one of said groups being spring loaded, the contacts of one of said groups having curved contact surfaces, the contacts of one of said groups being disposed in an inclined position prior to engagement with the contacts of the other group and arranged such that the contact surfaces of said inclined contacts perform a rolling motion along the contact surfaces of the other contacts following initial engagement between said groups of contacts, and depressing means engageable with said inclined contacts for inducing said rolling motion.

4. A contactor according to claim 3, wherein said movable contacts constitute both said inclined contacts and said spring-loaded contacts, a movable contact plate provided for carrying said inclined contacts, said depressing means being mounted on said movable contact plate to be engageable with said inclined contacts after the latter have been displaced in opposition to said spring load.

5. An electromagnetic contact comprising:

an electromagnetic block including an armature having a plunger part and a pole-contacting member on only one end of said plunger part, a bobbin carrying a coil wound thereon and having an axial through-hole in which said plunger part of said armature is inserted for axial displacement, an inner yoke extending around a peripheral portion of said coil and including a first end portion opposing said pole-contacting member of said armature, an outer yoke having a second end portion opposing said first end portion of said inner yoke for restricting said displacement of said pole-contacting member of said armature and a third end portion extending toward said plunger part of the armature, and a permanent magnet interposed between said inner and outer yokes, a coupling means coupled to said armature of said electromagnetic block for being displaceable therewith, a contact block including a group of stationary contacts and a group of movable contacts, said group of movable contacts being coupled to said coupling means for making and breaking contact with said stationary contacts in response to said displacement of said armature, the contacts of one of said groups being spring loaded, and adjusting means for adjusting the position of said electromagnetic block relative to said contact block in order to delay or advance the timing when the movable contacts are displaced in response to displacement of said armature.

6. A contactor according to claim 5, wherein said adjusting means comprises a wedge slidably disposed on the bottom of said electromagnetic block for finely adjusting the inclination of the electromagnetic block for varying the relationship between said coupling means and said contact block.

* * * * *